US005642767A

United States Patent [19]

Nair

[11] Patent Number: 5,642,767

[45] Date of Patent: Jul. 1, 1997

[54] UP CLOSING FIRE DOOR

[75] Inventor: Gopi Nair, Aurora, Colo.

[73] Assignee: TransLogic Corporation, Denver, Colo.

[21] Appl. No.: 571,406

[22] Filed: Dec. 13, 1995

[51] Int. Cl.[6] ..... E05F 15/20

[52] U.S. Cl. ..... 160/8; 160/189

[58] Field of Search ..... 160/1, 2, 3, 4, 160/6, 7, 8, 9, 35, 36, 189, 190, 84.02, 265, 311, 405, 84.04, 84.01, 167 R; 454/257, 369

[56] References Cited

U.S. PATENT DOCUMENTS

| | | | |
|---|---|---|---|
| 899,460 | 9/1908 | McCloud . | |
| 3,465,806 | 9/1969 | Sulkes | 160/167 R X |
| 3,807,480 | 4/1974 | Smart | 160/1 |
| 3,860,055 | 1/1975 | Wild | 160/1 |
| 3,915,377 | 10/1975 | Sutton | 160/1 X |
| 4,100,931 | 7/1978 | Pantland et al. | 160/1 X |
| 4,334,570 | 6/1982 | Adams | 160/1 |
| 5,129,442 | 7/1992 | Warner | 160/271 |
| 5,171,184 | 12/1992 | Saucier et al. | 160/1 X |
| 5,222,541 | 6/1993 | Hornberger | 160/265 |
| 5,355,927 | 10/1994 | McKeon | 160/7 |
| 5,377,737 | 1/1995 | Moriya et al. | 160/190 X |
| 5,393,263 | 2/1995 | McCabe | 160/1 X |

*Primary Examiner*—David M. Purol

*Attorney, Agent, or Firm*—Sheridan Ross P.C.

[57] ABSTRACT

A fire door system is disclosed wherein the fire door is up closing in that it includes an up closing partition. Further, the fire door is fail-safe in that in the absence of continuous controls indicating that the fire door should remain open, counterweights to the partition urge the partition upwardly for closing the fire door. Additionally, the fire door includes pneumatic chambers that interact with the movement of the counterweights so that as the partition is closing, a build-up of pressure in the chambers slows the rate of closing so that the fire door closes without slamming even though the total time taken to close the fire is rapid. The fire door is particularly useful for preventing the spread of fire and fire byproducts from one side of a fire inhibiting wall to the other side through openings such as those provided for carrier transport systems.

18 Claims, 7 Drawing Sheets

UP CLOSING FIRE DOOR

FIELD OF THE INVENTION

The present invention relates to an up closing fire door, and in particular, to a fail-safe fire door that closes via gravitational movement of a counterweight, and preferably closes smoothly due to an interaction of one or more pneumatic chambers with the movement of the counterweight.

BACKGROUND OF THE INVENTION

Carrier transport systems include carriers for transferring articles contained therein between carrier transport stations. These systems provide a carrier track to which carriers are attached. If such carrier tracks traverse sections of a building wherein the sections are designed with fire inhibiting building walls to inhibit the spread of fire and fire byproducts, then these openings may allow spreading of a fire or fire byproducts from one side of the fire inhibiting wall to the other. Fire doors are commonly provided in these openings.

For such carrier transport systems having carrier tracks located near the ceiling so that carriers hang from the tracks, it is beneficial to provide up closing fire doors. However, since such fire doors can be of substantial weight, if a motor is used to close an up closing fire door, then the minimum required rate of speed at which the fire door must close for safety standards necessitates a large, relatively expensive motor. Further, if a motor is used, electrical power must be available during a fire to close the fire door. This is not a fail safe method. Counterweights could be used to close the fire door, as done in this invention. Then additional controls may be required to prevent the fire door from slamming closed and thereby disturbing building occupants during periodic fire door testings.

Thus, it would be advantageous to have an up closing fire door that meets appropriate safety standards in terms of speed of closing and yet does not slam while closing. It is further advantageous not to require electrical power to close the fire door and use a relatively small motor to execute the act of opening the fire door, a non-critical function with regard to safety.

SUMMARY OF THE INVENTION

The present invention is an up closing fire door that utilizes a counterweight to close (i.e. raise) a vertically moveable partition of the fire door wherein the vertically moveable partition, when closed, inhibits a fire and/or fire byproducts from progressing beyond the fire door. That is, when the counterweight is allowed to free-fall, the fire door partition is drawn upwardly for closing using a cable and pulley configuration for operatively connecting the counterweight to the fire door partition.

Furthermore, the counterweight is slidable as one or more pistons in one or more vertical cylinders during the opening and closing of the fire door partition, wherein upon up closing of the fire door partition, the free-fall of the counterweight is slowed by pneumatic or air pressure that builds up within the cylinder(s) below the counterweight. However, the pressure is able to slowly dissipate from the cylinder(s) due to a slow pressure relieving port in the substantially closed bottom of each such vertical cylinder. Thus, although the overall rate at which the fire door partition tends to close may be rapid, the build-up of pressure in combination with the slow pressure relieving port provides for a smooth and quiet closing of the fire door partition.

Thus, the following additional aspects are provided by the present invention.

It is an aspect of the present invention that relatively low powered and inexpensive motors may be used to open (downwardly) the fire door partition of the present invention since the opening of the fire door partition is not typically of a time critical nature.

It is a further aspect of the present invention that the fire door include a brake and an electronic controller wherein the brake, when applied, overcomes the gravity induced force on the counterweight to thereby retain the fire door partition in an open position. Furthermore, the controller controls the engaging and disengaging of the brake according to one or more of the following inputs: a remotely generated signal to close or open the fire door from, for example, a fire control center; and a smoke detecting sensor at the fire door that may also provide a brake releasing signal if sufficient fire byproducts are detected in the area about the fire door.

It is also a further aspect of the present invention that a detection of a temperature above a predetermined threshold at the fire door induces the release of the brake thereby allowing the fire door to close.

Thus, it is an object of the present invention to provide a substantially fail-safe mechanism for closing the fire door partition. Note that this object is particularly important in environments such as where there are openings in fire inhibiting walls to permit passage of automated transport carriers in that such locations may not easily be accessible for maintenance, and maintenance of such fire doors is likely to require the shutting down of at least a portion of the carrier transport system providing the carriers.

Other features and benefits of the present invention will become apparent from the detailed description with the accompanying figures contained hereinafter.

DETAILED DESCRIPTION

Figure 1:
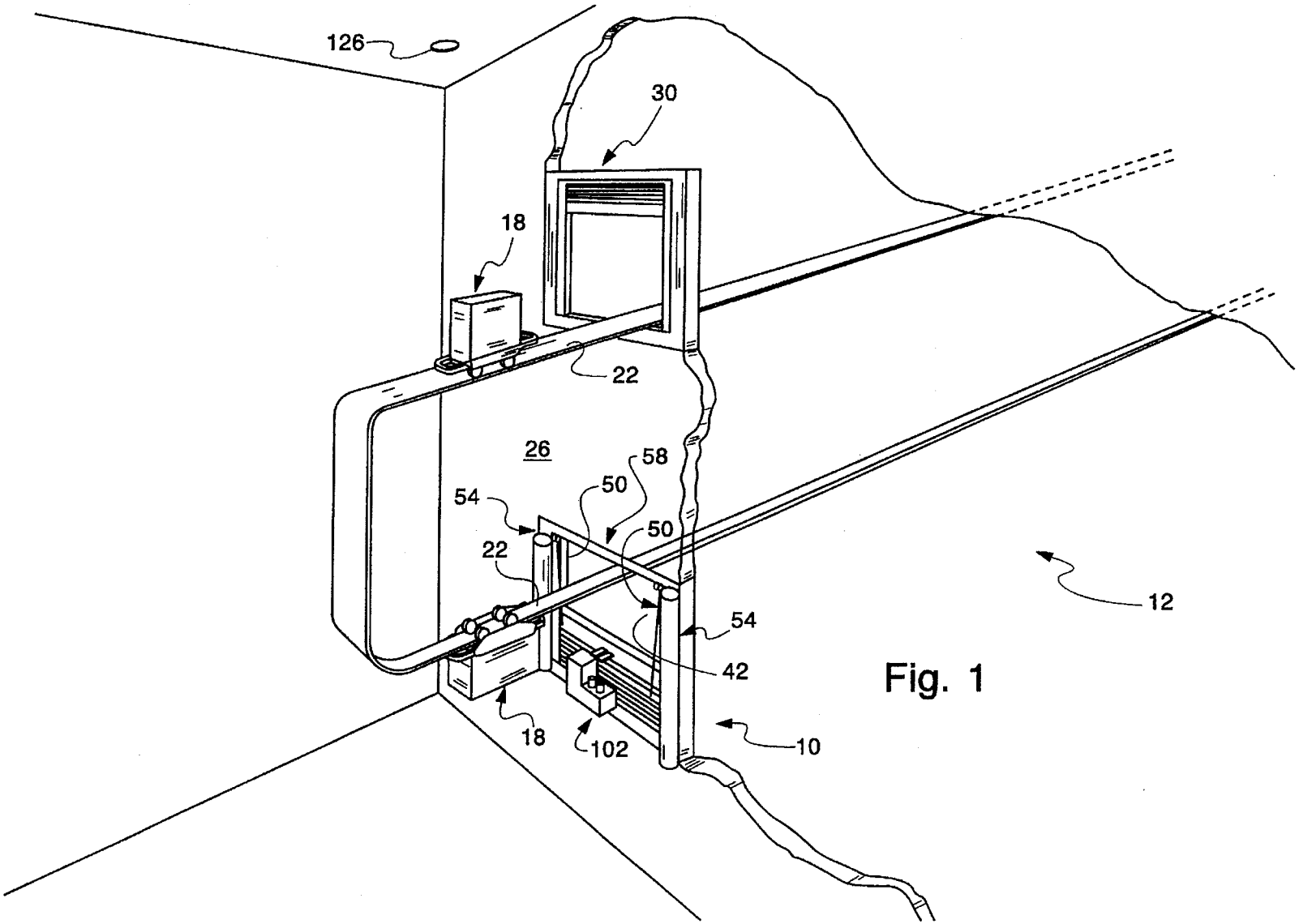
FIG. 1 illustrates the up closing fire door 10 of the present invention embedded within a fire wall 26 so that when open (as illustrated in this Figure), carriers 18 can move through the fire door opening 42.
Figure 2:
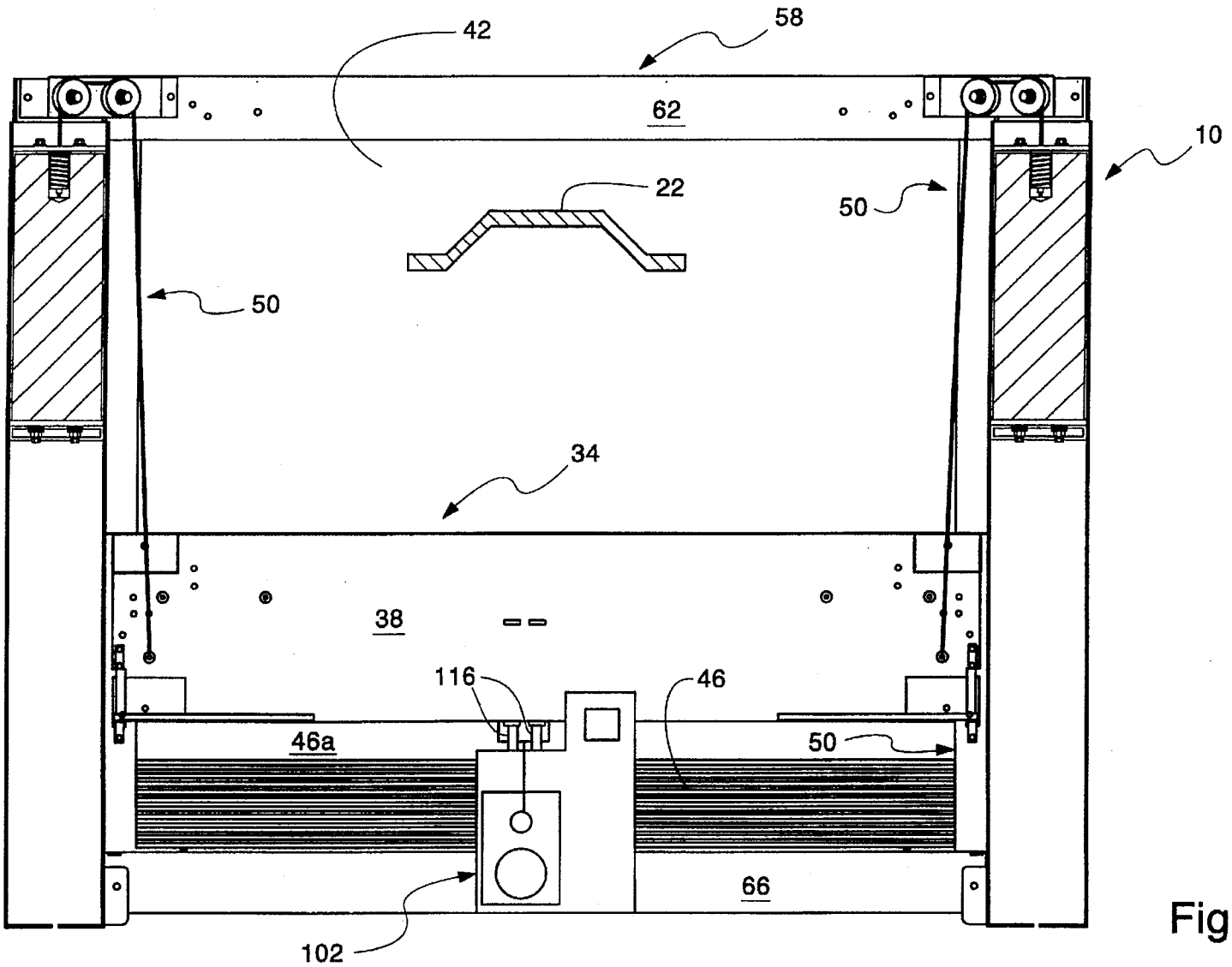
FIG. 2 presents a rear view of the fire door 10 in an open position.

FIG. 1 shows an up closing fire door 10 of the present invention in the context of a carrier transport system 12 (CTS). In particular, the fire door 10 is positioned within a fire inhibiting wall 26 (shown partially cut away for better illustration) of the CTS 12 through which carriers 18 travel on a track 22. The fire door 10, as illustrated, may be embedded within a fire inhibiting building wall 26 along with other fire doors such as, for example, down closing fire door 30.

Figure 3:
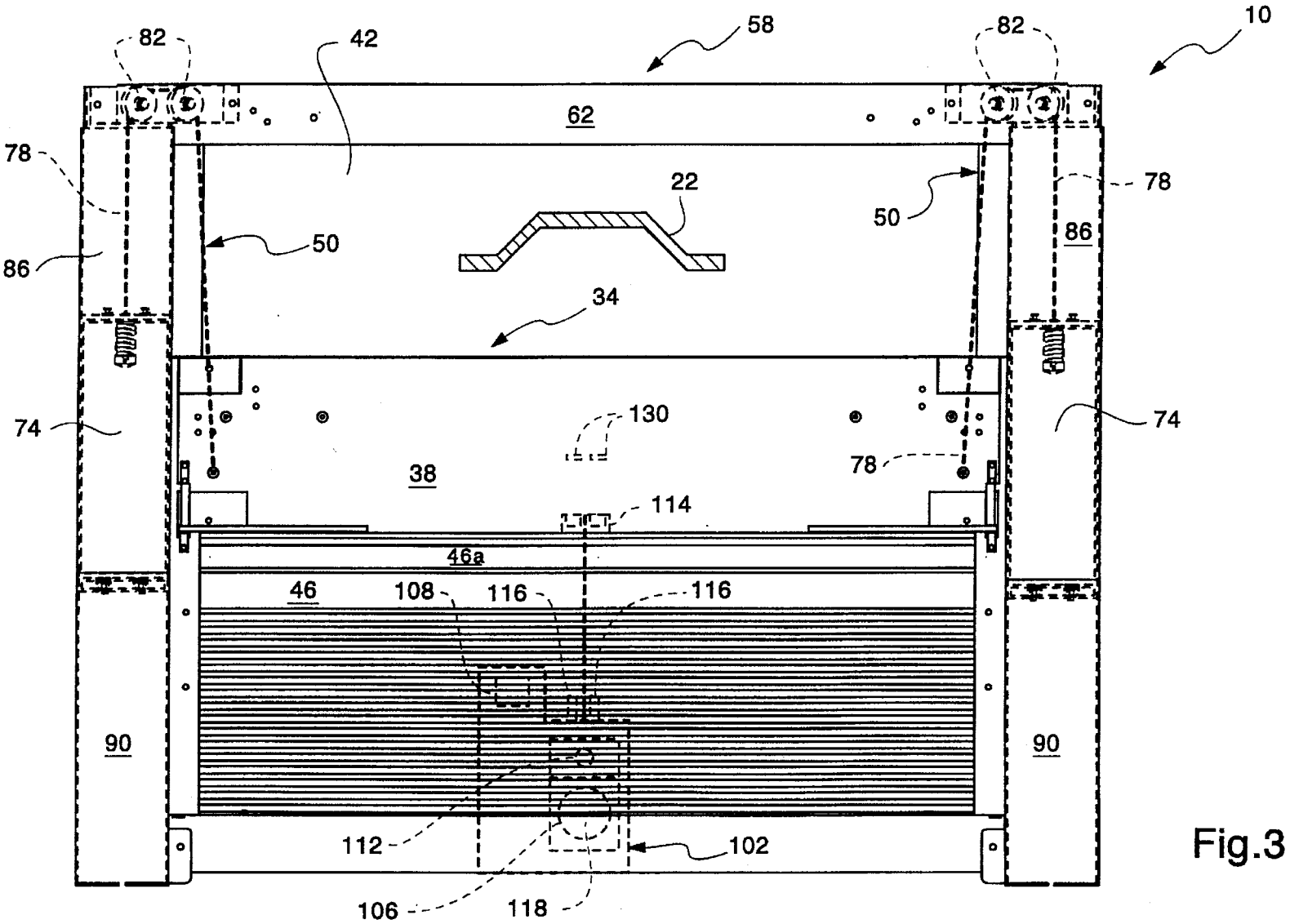
FIG. 3 presents a front view of the fire door 10 in a partially open position.
Figure 4:
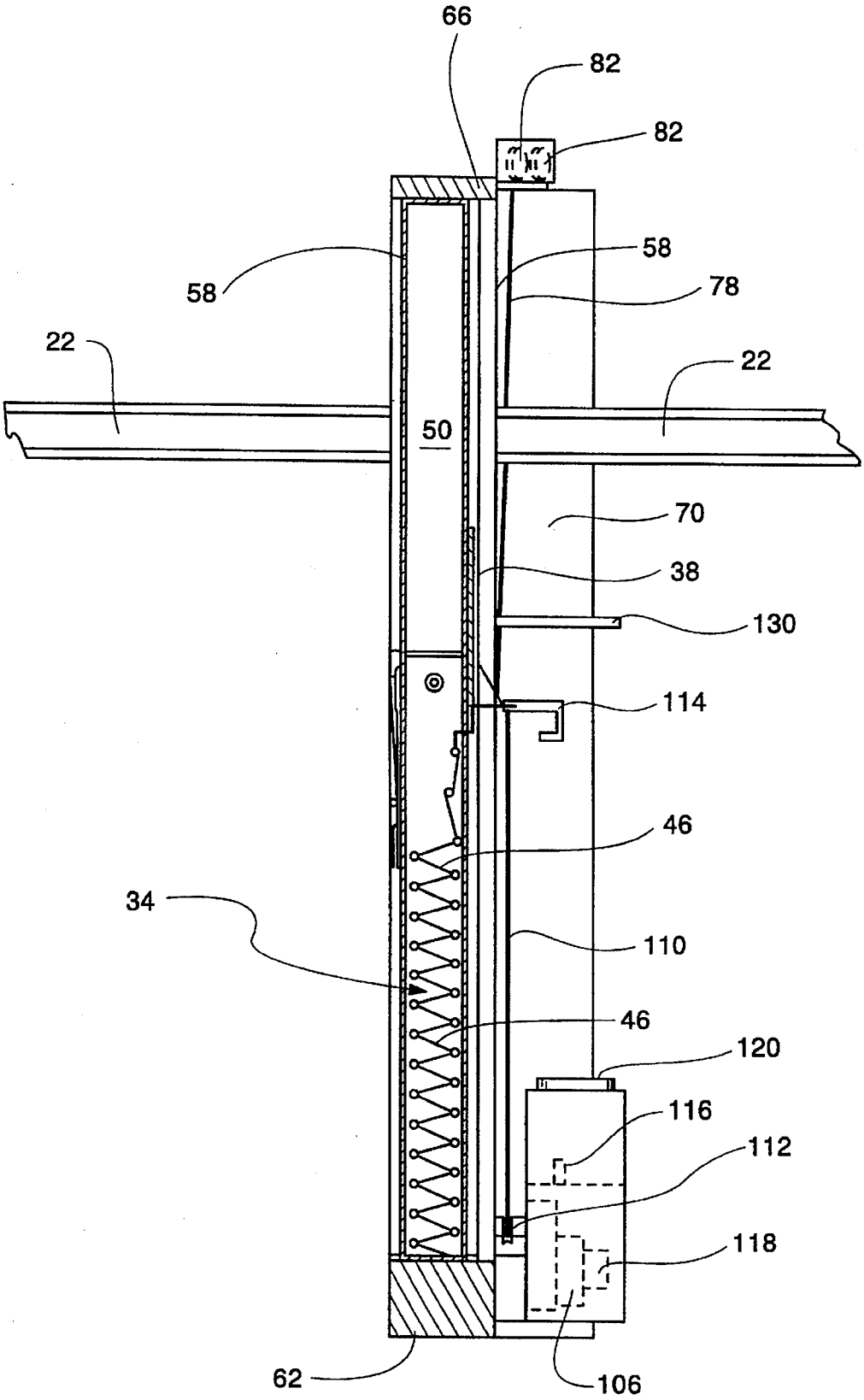
FIG. 4 is a side view of the fire door 10 wherein one of the vertical sides of the fire door frame has been removed.

Referring now to FIGS. 1–6, the fire door 10 will be described in detail. The fire door 10 includes a vertically movable partition 34 for closing and opening the fire door 10 (e.g., FIG. 2). The uppermost portion of the partition 34 has a rigid plate 38 horizontally spanning the fire door opening 42. As best shown in FIG. 4, the partition 34 further includes interlocked accordion style horizontal slats 46 that are capable of both folding onto one another in a compact arrangement in a lower portion of the opening 42 as in FIG. 2, or unfolding (although remaining interlocked) to create a fire barrier when the partition 34 fully blocks the opening 42 as in FIG. 5.

The partition slats 46 are vertically slidable in opposing vertical channels 50 (FIGS. 1 and 4) at the sides of the passageway opening 42, each such channel 50 being attached to a vertical side 54 of a rectangular frame 58 surrounding the fire door partition 34. The frame 58 also includes both upper and lower horizontal cross members 62 and 66, respectively. Further, the top or vertically uppermost slat **46*a* is attached to the plate 38 while the bottom most slat 46 is attached to the lower horizontal cross member 62**.

Figure 5:
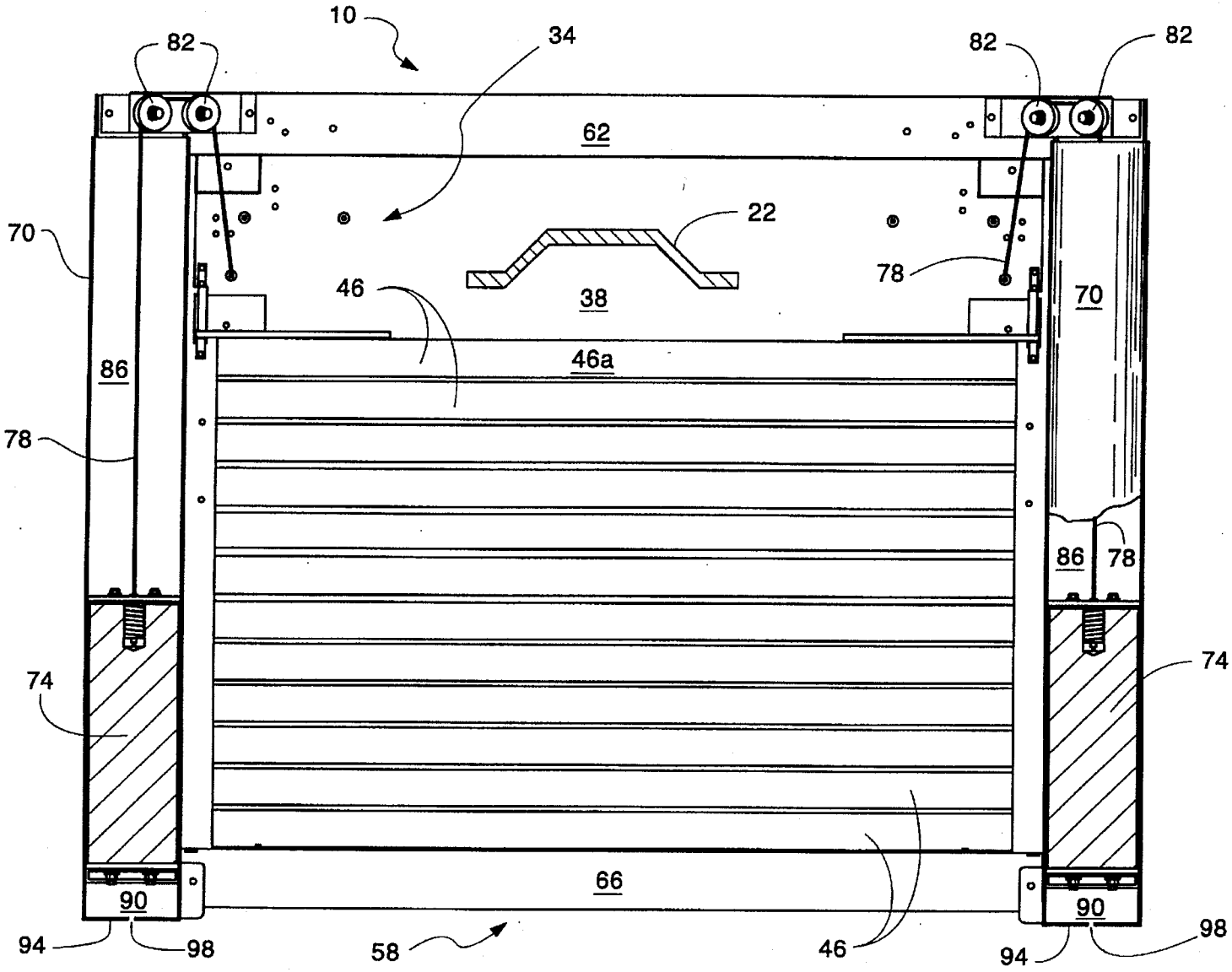
FIG. 5 is a rear view of the fire door 10 in a fully closed position.
Figure 6:
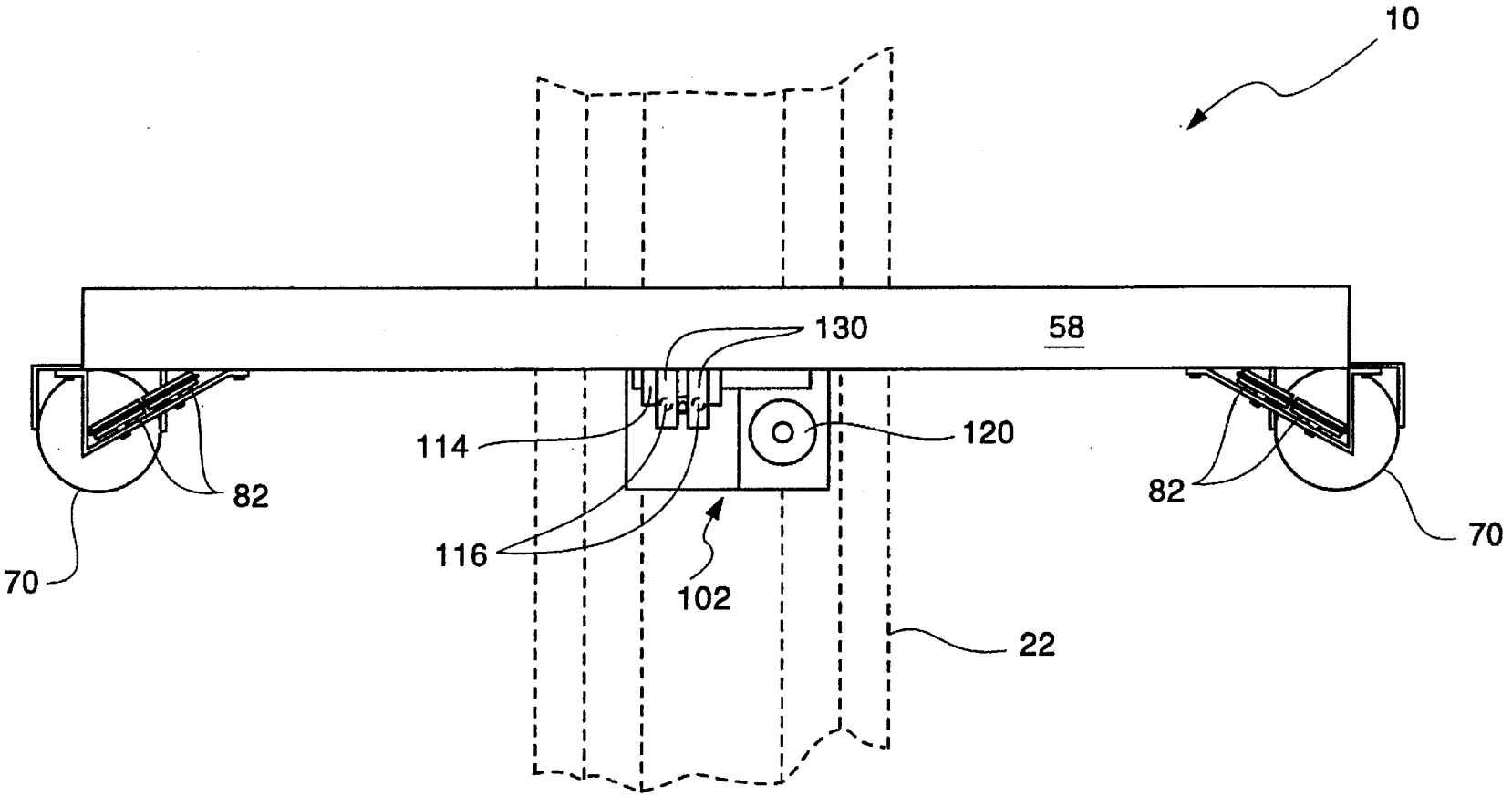
FIG. 6 is a top view of the fire door 10.

As best shown in FIGS. 5 and 6, mounted on the frame 58 adjacent each frame side 54 is a cylinder 70 having a counterweight 74 slidably contained therein as a piston. Each counterweight 74 is operatively connected to the plate 38 by a cable 78 wherein a center portion of the cable runs over a pair of pulleys 82. Thus, the counterweights 74 slide in a vertically opposite direction to the movement of the partition 34. Further, note that the total weight of the counterweights 74 is sufficient to draw the partition 34 upward and into a closed position as in FIG. 5.

Additionally, note that each counterweight 74 fits snugly within its corresponding cylinder 70 so that the air chamber 86 above each counterweight 74 has little air flow with the corresponding air chamber 90 below the counterweight. Thus, since the lower end 94 of each cylinder 70 is substantially closed with the exception of a pressure relieving port 98, the air in each chamber 90 compresses when the corresponding counterweight 74 moves downward thereby increasing the air pressure in each chamber 90. Thus, as the counterweights 74 approach the lower ends 94, the increased air pressure slows the counterweights' downward movement so that the partition 34 closes smoothly and quietly. In one embodiment, the pressure relieving port 98 is fixed in size so that the port size or opening is predetermined for the particular use or environment in which the fire door is employed. That is, depending on such factors, the port size can be greater or smaller, but fixed in size, for its particular application. In another embodiment, the port size is adjustable where an adjusting device or mechanism can be utilized to change the port size to a desired opening for controlling the amount of air pressure and movement of the counterweight.

Figure 7:
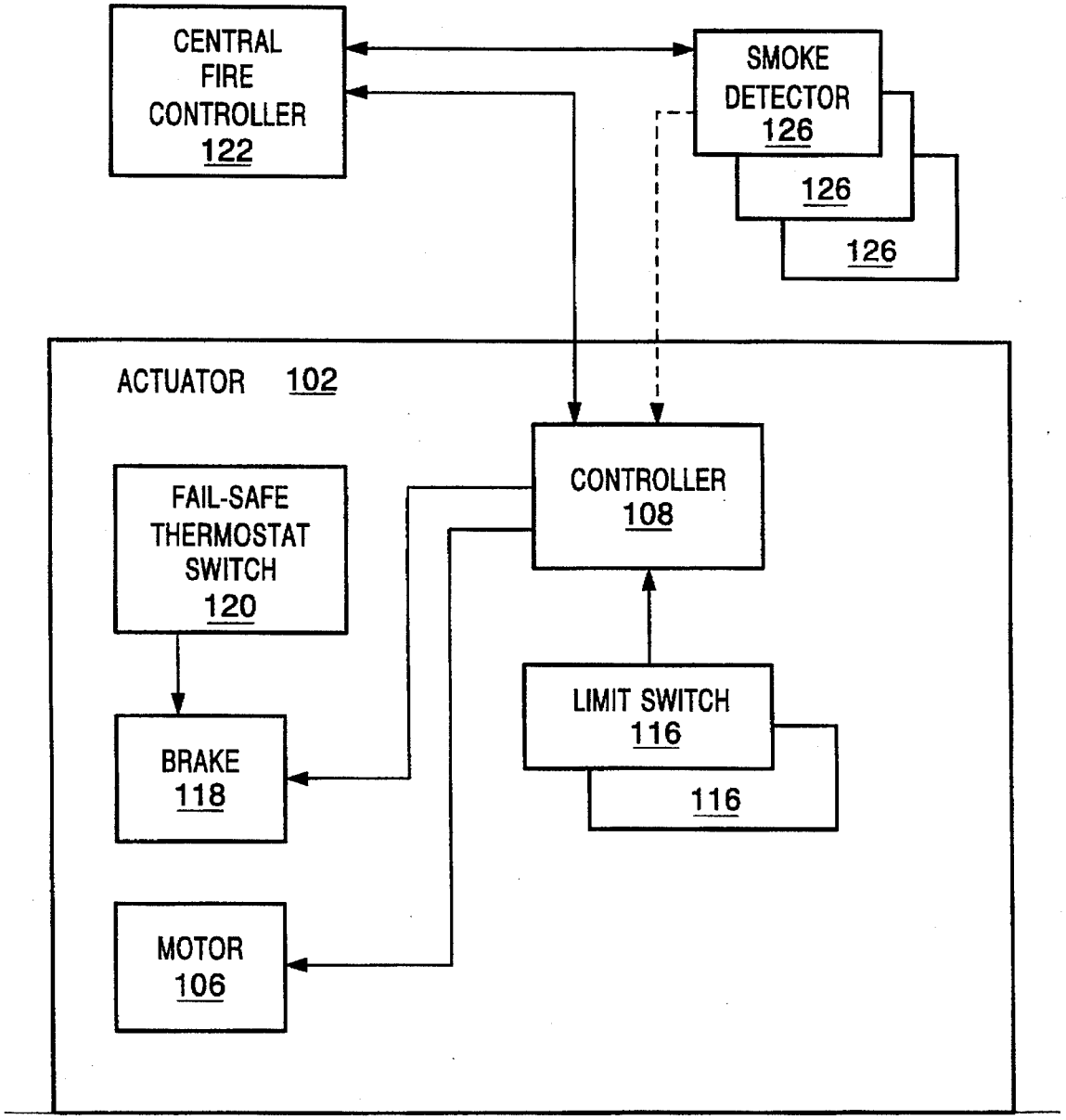
FIG. 7 is a high level diagram of the electronic components and their connections for the fire door 10.

On the side of the fire door 10 having the cylinders 70, there is an actuator 102 for controlling the movement of the fire door partition 34. Note that for physical positioning and layout of the actuator 102 and its components reference is made substantially to FIGS. 3 and 4. However, for a high level electrical schematic reference is made to FIG. 7. The actuator 102 includes a relatively low power electric motor 106 that is used for opening the fire door 10. The actuator 102 also includes a controller 108 for controlling the activation of the motor 106. Thus, when the motor 106 is activated by signals from the controller 108, the motor 106 induces (via a linkage not shown) the rotation of the cable cylinder 112 (FIG. 4) which, in turn causes the cable 110, having an end attached to the cable cylinder, to wind about the cable cylinder. Since the opposite end of the cable 110 is attached to the plate 38, upon motor 106 activation, the partition 34 is pulled downward thereby opening the fire door 10.

Further note that to detect that the fire door is fully open, one or more limit switches 116 (FIGS. 3, 6, and 7) are provided for sensing when the partition 34 is fully retracted. More precisely, as the partition 34 nears full retraction, the limit switches 116 are pressed down by stops 130 that project horizontally from the plate 38 (FIGS. 3, 4, and 6). If the downward motion of the partition 34 continues, then the limit switches 116 eventually signal the controller 108 that the fire door 10 is fully open and the controller then deactivates the motor 106, and sends a status message to a central fire controller 122 (described hereinbelow).

The actuator 102 further includes a brake 118 for locking the motor 106 in a fixed position which in turn prevents the cable cylinder 112 from moving. Thus, the brake 118 fixes the length of the cable 110 between the cable cylinder 112 and the plate 38 and thereby can maintain the partition 34 in an open (i.e. retracted) position by overcoming the gravity induced force of the counterweights 74 that urges the partition 34 upward. Note that the brake 118 is electronically activated. Thus, to engage and keep the brake 118 engaged, an electrical signal must be continually applied to the brake. Further, the brake 118 may be both activated and deactivated by the controller 108.

It is an important aspect of the fire door 10 that the signal to actuate the brake 118 is serially routed through a fail-safe thermostat switch 120 before being provided to the brake 118. Thus if there is heat above a predetermined threshold at the fire door 10, a circuit (not shown) within the thermostat switch 120 opens and thereby breaks the electrical circuit to the brake 118. This assures that the brake 118 disengages and consequently that the fire door 10 is not hindered from closing. Thus, the thermostat switch 120 provides a substantially fail-safe capability wherein the fire door 10 automatically closes if excessive heat is detected.

Referring now to the controller 108 (FIG. 7) and its electrical communications, note that the controller is in signal communication with the central fire controller 122 which monitors and controls various fire detection and containment devices within, for example, a building having the fire door 10. Accordingly, the central fire controller 122, for example, may periodically perform tests wherein the controller 108 is instructed to close and/or open the fire door 10. In response to such instructions the controller 108: (a) deactivates the brake 118 for closing the fire door 10, and/or (b) activates the motor 106 for opening the fire door 10 and subsequently engages the brake 118 for retaining the fire door 10 in the open position. Optionally, the controller 108 may also receive signals from one or more smoke detectors 126 placed in proximity to the fire door 10 as shown in FIG. 1. Note that such smoke detectors are also in signal communication with the central fire controller 122 for alerting the central fire controller 122 of detected smoke.

Thus, assuming the partition 34 is not closed, the fire door 10 of the present invention will close due to the gravitational force on the counterweights 74 unless there is a continuous electrical signal supplied to maintain the engagement of the brake 118. Furthermore, the brake 118 may be disengaged via signals from the controller 108, or alternatively, the brake 118 may be disengaged if local temperatures at the fire door 10 exceed a predetermined threshold. Moreover, the fire door 10 closes at an acceptable rate of speed, but without slamming so as to distract building occupants during periodic fire drill procedures.

The foregoing discussion of the invention has been presented for purposes of illustration and description. Further, the description is not intended to limit the invention to the form disclosed herein. Consequently, variation and modification commiserate with the above teaching, and within the siill and knowlidge of the teachings, and within the skill and knowledge of the relevant art, are within the scope of the present invention. The embodiment described herein above is further intended to explain the best mode presently known of practicing the invention and to enable others skilled in the art to utilize the invention as such, or in other embodiments, and with the various modifications required by their particular application or uses of the invention. It is intended that the appended claims be construed to include alternative embodiments to the extent permitted by the prior art.

What is claimed is:

1. An upwardly closing fire door assembly comprising:

door means, moveable between a closed position and an open position, for: (a) partitioning a first space from a second space when said door means is in said closed position, and (b) providing an opening between the first and second spaces when said door means is in said open position; and counterweight means for moving said door means with a weighted portion of said counterweight means, wherein said counterweight means actuates said door means between said open and closed positions by gravitational induced movement of said weighted portion;

wherein said counterweight means includes a cable and pulley means, operatively connected to said door means and said weighted portion, for transferring said gravitational induced movement into an upward movement of said door means.

2. A fire door assembly as claimed in claim 1, wherein said door means includes a partition of hinged slats extendable in said closed position and retractable in said open position.

3. An upwardly closing fire door assembly comprising:

door means, moveable between a closed position and an open position, for: (a) partitioning a first space from a second space when said door means is in said closed position, and (b) providing an opening between the first and second spaces when said door means is in said open position;

counterweight means for moving said door means with a weighted portion of said counterweight means, wherein said counterweight means actuates said door means between said open and closed positions by gravitational induced movement of said weighted portion; and an actuator means for actuating at least one of a closing and an opening of said door means.

4. A fire door assembly as claimed in claim 3, wherein said actuator means includes a motor means for opening said door means.

5. A fire door assembly as claimed in claim 3, wherein said actuator means includes means for maintaining said fire door means in said open position.

6. A fire door assembly as claimed in claim 5, wherein said means for maintaining includes a brake that is engaged electronically.

7. An upwardly closing fire door assembly comprising:

door means, moveable between a closed position and an open position, for: (a) partitioning a first space from a second space when said door means is in said closed position, and (b) providing an opening between the first and second spaces when said door means is in said open position, counterweight means for moving said door means with a weighted portion of said counterweight means, wherein said counterweight means actuates said door means between said open and closed positions by gravitational induced movement of said weighted portion; and detection means for detecting a condition in a proximity of said door means that relates to one of a fire and a fire byproduct.

8. A fire door assembly as claimed in claim 7, wherein said detection means includes at least one of (a) a thermostat switch for detecting an increase in temperature and (b) a smoke detector for detecting a fire byproduct.

9. An upwardly closing fire door assembly comprising:

door means, moveable between a closed position and an open position for: (a) partitioning a first space from a second space when said door means is in said closed position, and (b) providing an opening between the first and second spaces when said door means is in said open position;

counterweight means for moving said door means with a weighted portion of said counterweight means, wherein said counterweight means actuates said door means between said open and closed positions by gravitational induced movement of said weighted portion; and means for controlling movement of said door means upon detection of at least a first condition.

10. A method for actuating a fire door, comprising:

providing a vertically moveable fire door within an opening between a ceiling and a floor through which a carrier travels;

establishing said fire door in an open position so that the carrier passes through said fire door;

urging said fire door towards said ceiling for closing said fire door and thereby partitioning the opening into first and second spaces so that at least one of a fire and a fire byproduct in the first space is substantially inhibited from entering the second space;

wherein said step of urging includes a step of inducing gravitational movement of a counterweight for closing said fire door.

11. A method as claimed in claim 10, further including a step of providing a pressure change within a contained volume wherein said pressure change is related to a movement of said counterweight so that said pressure change decreases a rate of said gravitational movement of said counterweight as said fire door becomes substantially closed.

12. A method as claimed in claim 11, wherein said step of providing a pressure change includes one of providing a pressure relieving port that is fixed in size and providing a pressure relieving port that is adjustable in size.

13. A method as claimed in claim 10, wherein said step of establishing includes activating a motor for opening said fire door by counter acting said counterweight.

14. A method as claimed in claim 10, wherein said step of urging includes detecting, in a proximity of said fire door, one of an increasing temperature and a fire byproduct.

15. A method as claimed in claim 10, wherein said step of inducing includes releasing a mechanism for maintaining the fire door in said open position.

16. A method as claimed in claim 10, wherein said step of urging includes allowing a gravitational force on said counterweight to overcome all counter forces inhibiting a movement of said fire door towards said ceiling.

17. A method for actuating a fire door, comprising:

providing a vertically moveable fire door within an opening between a ceiling and a floor through which a carrier travels;

establishing said fire door in an open position so that the carrier passes through said fire door;

urging said fire door toward said ceiling for closing said fire door and thereby partitioning the opening into first and second spaces so that at least one of a fire and a fire product in the first space is substantially inhibited from entering the second space; and detecting a condition in proximity of said fire door that relates to one of the fire and the fire byproduct.

18. A method for actuating a fire door, comprising:

providing a vertically moveable fire door within an opening between a ceiling and a floor through which a carrier travels;

establishing said fire door in an open position so that the carrier passes through said fire door;

urging said fire door toward said ceiling for closing said fire door and thereby partitioning the opening into first and second spaces so that at least one of a fire and a fire byproduct in the first space is substantially inhibited from entering the second space; and controlling movement of said fire door upon detection of at least a first condition.

* * * * *